US005152851A

United States Patent [19]

Yamamoto et al.

[11] Patent Number: 5,152,851

[45] Date of Patent: Oct. 6, 1992

[54] HIGH-STRENGTH COIL SPRING AND METHOD OF PRODUCING SAME

[75] Inventors: Susumu Yamamoto; Takeshi Shibata, both of Itami, Japan

[73] Assignee: Sumitomo Electric Industries, Ltd., Osaka, Japan

[21] Appl. No.: 707,977

[22] Filed: May 23, 1991

Related U.S. Application Data

[63] Continuation-in-part of Ser. No. 433,207, Nov. 8, 1989, abandoned.

[30] Foreign Application Priority Data

Nov. 10, 1988 [JP] Japan ..... 63-282140
Nov. 10, 1988 [JP] Japan ..... 63-282141

[51] Int. Cl.[5] ..... C21D 9/02; C22C 38/24

[52] U.S. Cl. ..... 148/333; 148/908; 148/580; 148/602

[58] Field of Search ..... 267/166, 167, 286; 148/12.4

[56] References Cited

U.S. PATENT DOCUMENTS 4,090,866 3/1990 Abe et al. ..... 148/908

FOREIGN PATENT DOCUMENTS 973659 11/1982 U.S.S.R. ..... 148/333

*Primary Examiner*—Deborah Yee
*Attorney, Agent, or Firm*—Winderoth, Lind & Ponack

[57] ABSTRACT

The present invention relates to a high-strength coil spring useful for an engine and other high-strength springs requiring a high fatigue-resistance and a method of producing the same.

In general, a higher tensile strength is desired for spring materials but it has been known that if a tensile strength exceeds a certain limit, a toughness and a fatigue resistance are contrarily reduced.

In addition, a coil spring has been used after forming and then being subjected to a quenching treatment followed by being subjected to a shot peening treatment to add a compressive residual stress to a surface thereof but an effective shot peening treatment gives a surface roughness Rmax of 6 to 20 μm, so that not only it has been impossible to remove surface defects having a surface roughness of 6 to 20 μm or less but also impressions due to the shot peening have covered the surface defects to be turned into injured portions and fatigue nuclei in many cases.

In view of the above description, the present invention has found a high-strength coil spring with high fatigue resistance using a clean steel wire, such as chromium-vanadium steel wire and chromium-silicon steel wire, by forming it in the shape of a spring, quenching and tempering at lower temperatures to heighten the tensile strength, and being subjected to a shot peening treatment followed by being subjected to an electrolytic polishing treatment, which does not exert a bad influence on fatigue resistance, to remove surface defects and a method of producing the same.

10 Claims, 4 Drawing Sheets

HIGH-STRENGTH COIL SPRING AND METHOD OF PRODUCING SAME

This application is a continuation-in-part of now abandoned application, Ser. No. 07/433,207 filed on Nov. 8, 1989 now abandoned.

DETAILED DESCRIPTION OF THE INVENTION

1. Field of the Invention

The present invention relates to a high-strength coil spring and a method of producing the same. The coil spring according to the present invention is effectively used as a high-strength spring for an engine and other high-strength springs requiring a high fatigue resistance.

2. Prior Art

In general, a higher tensile strength is desired for spring materials but it has been known that if a tensile strength exceeds a certain limit, the toughness and a fatigue resistance are correspondingly reduced.

In addition, a coil spring has been used after forming which is then subjected to a quenching treatment followed by being subjected to a shot peening treatment to add a compressive residual stress to a surface thereof, but an effective shot peening treatment gives a surface roughness Rmax of 6 to 20 μm, so that not only it has been impossible to remove surface defects having a surface roughness of 6 to 20 μm or less but also impressions due to the shot peening have covered the surface defects to be turned into damaged portions and fatigue nuclei in many cases. It goes without saying that the Rmax can be reduced by the subsequent various kinds of polishing treatment but since a surface layer is removed, portions, to which a compressive residual stress has been applied, of an outer layer introduced with much trouble is lost, whereby the fatigue resistance is reduced.

PROBLEMS TO BE SOLVED BY THE INVENTION

It is expected that if clean steels, of which the concentration of nonmetallic inclusions has been reduced, such as chromium-vanadium steel and chromium-silicon steel, are used, also the conditions for drawing forth the highest fatigue resistance as a spring are different from the conventional ones. That is to say, the tensile strength of the present chromium-vanadium steel and chromium-silicon steel is set so that the best fatigue properties may be obtained with a level of inclusions and surface defects in the conventional materials as the base but it can be expected that if merely the problems of surface defects are solved for the clean steels, the fatigue resistance can be improved by still further heightening the tensile strength.

MEASURES FOR SOLVING THE PROBLEMS

In view of the above description, the present invention has found a high-strength coil spring with high fatigue resistance using a clean steel wire, such as a chromium-vanadium steel wire and a chromium-silicon steel wire, by forming it in the shape of a spring, quenching and tempering at lower temperatures to heighten the tensile strength, and subjecting it to a shot peening treatment followed by subjecting it to an electrolytic polishing treatment. This procedure does not exert a bad influence on fatigue resistance and removes surface defects.

That is to say, the present invention provides (1) A high-strength coil spring, characterized in that its surface roughness Rmax is made 5 μm or less by coiling a steel wire formed of steels comprising C of 0.4 to 1.0% by weight, Si of 0.1 to 2.0% by weight, Mn of 0.4 to 1.2% by weight, Cr of 0.3 to 1.5% by weight, V of 0.001 to 0.3% by weight and the remainder Fe and inevitable impurities, of which the cleanness is 0.01% or less, and then subjecting the coiled steel wire to a quenching treatment and a tempering treatment to regulate its tensile strength followed by subjecting to a shot peening treatment and a polishing treatment. The cleanliness of the steel is measured by the so-called "index of cleanliness" as described in JIS G 0555. This index of cleanliness is designed to measure the amount of nonmetallic inclusions in the steel and other impurities according to the formula:

$$d = \frac{n}{P \times f} \times 100$$

where,

P: Total number of grating points on the glass plate in the visual field f: Number of the visual fields n: Number of grating points occupied by the inclusions through the visual fields numbering f.

(2) A method of producing a high-strength coil spring, characterized in that its surface roughness Rmax is made 5 μm or less by coiling a steel wire formed of steels comprising C of 0.4 to 1.0% by weight, Si of 0.1 to 2.0% by weight, Mn of 0.4 to 1.2% by weight, Cr of 0.3 to 1.5% by weight, V of 0.001 to 0.3% by weight and the remainder Fe and inevitable impurities, of which cleanness is prepared at 0.01% or less, and then subjecting the coiled steel wire to a quenching treatment and a tempering treatment to regulate its tensile strength followed by subjecting to a shot peening treatment and a polishing treatment.

DESCRIPTION OF THE DRAWINGS

FIG. 1(A) to (D) is a graph showing the relation between the tempering temperatures and mechanical properties of a chromium-silicon steel wire quenched in oil, in which FIG. 1(A) shows the relation between the tempering temperature and the hardness;

FIG. 1(B) shows the relation between the tempering temperature and the tensile strength;

FIG. 1(C) shows the relation between the tempering temperature and the reduction of area; and FIG. 1(D) shows the relation between a tempering temperature and the fatigue strength.

OPERATION

When a steel wire formed of steels comprising C of 0.4 to 1.0% by weight, Si of 0.1 to 2.0% by weight, Mn of 0.4 to 1.2% by weight, Cr of 0.3 to 1.5% by weight, V of 0.001 to 0.3% by weight and the remainder Fe and inevitable impurities is used as a material in the present invention, the reason why (i) the cleanness is prepared at 0.01% or less is so that the fatigue fracture due to the non-metallic inclusions contained in the steel wire having the above described chemical composition is avoided. This can be achieved by devising the deoxidation method such as to optimize the vacuum degassing and a refining slag conditions.

In addition, the reason why (ii) the quenching treatment and the tempering treatment are carried out after the coiling is that if such procedures are carried out before the coiling, the high-strength material according to the present invention is apt to be insufficient in toughness and also its sensitivity to a surface defects is strong, so that the probability of breakage during coiling would increase.

Furthermore, the reason why (iii) the tensile strength of the chromium-vanadium steel wire quenched in oil for use in the valve-spring by the present invention is increased by 10% in comparison with the values provided in Table 3-2 of JIS G-3565 and the tensile strength of the chromium-silicon steel wire quenched in oil for use in the valve-spring by the present invention is increased by 10% in comparison with the values provided in Table 3-1 of JIS G-3566 is because the surface defects and inclusions are removed, which means that the matrix has a sufficient toughness and also the fatigue strength can be enhanced.

TABLE 3-2

(Tensile strength as described in JIS G 3566)

| Standard wire diameter[1] mm | Tensile strength N/mm$^2$ |
|---|---|
| 1.60 | 1960 to 2110 |
| 1.80 | 1960 to 2110 |
| 2.00 | 1910 to 2060 |
| 2.30 | 1910 to 2060 |
| 2.60 | 1910 to 2060 |
| 2.90 | 1910 to 2060 |
| 3.20 | 1860 to 2010 |
| 3.50 | 1860 to 2010 |
| 4.00 | 1810 to 1960 |
| 4.50 | 1810 to 1960 |
| 5.00 | 1760 to 1910 |
| 5.50 | 1760 to 1910 |
| 6.00 | 1710 to 1860 |
| 6.50 | 1710 to 1860 |
| 7.00 | 1660 to 1810 |
| 8.00 | 1660 to 1810 |

Note [1]The standard wire diameters shall be as specified in 5.1 of JIS G 3566.
Remarks: For an intermediate diameter, the tensile strength specified of the nearest larger wire diameter shall be applied.

FIG. 1(A) to (D) are graphs showing the influences of the lowering of the tempering temperature for a chromium-silicon steel wire having a diameter of 4.0 mm quenched in oil as opposed to conventional materials (tempered at 400° C. for obtaining a tensile strength corresponding to JIS G-3566) upon the mechanical properties of the steel wire such as hardness, the tensile strength of the wire reduction in area and fatigue strength.

Figure 1B:
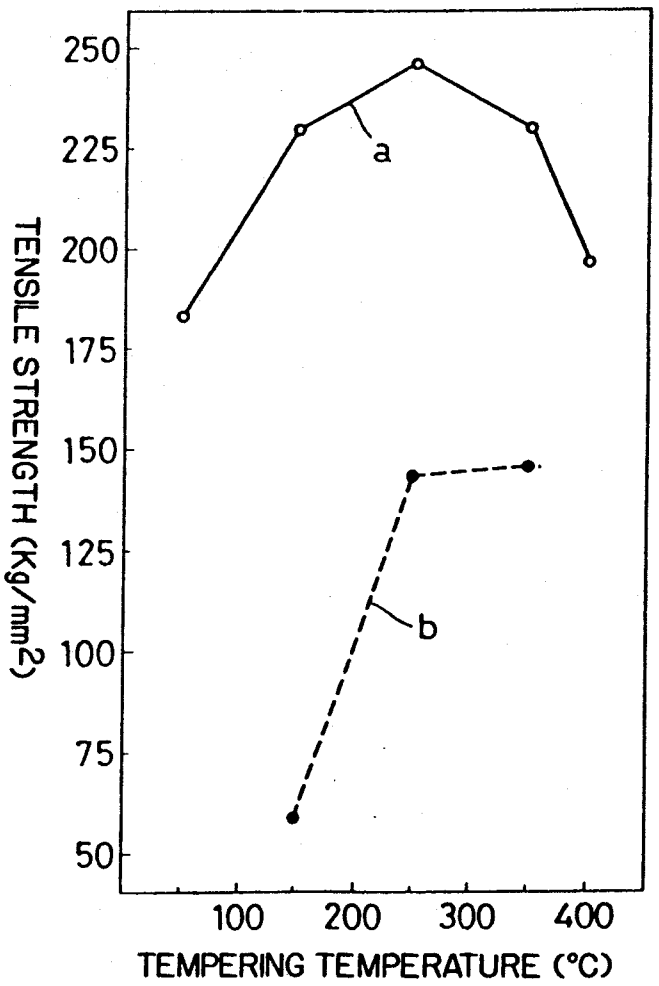
Figure 1A:
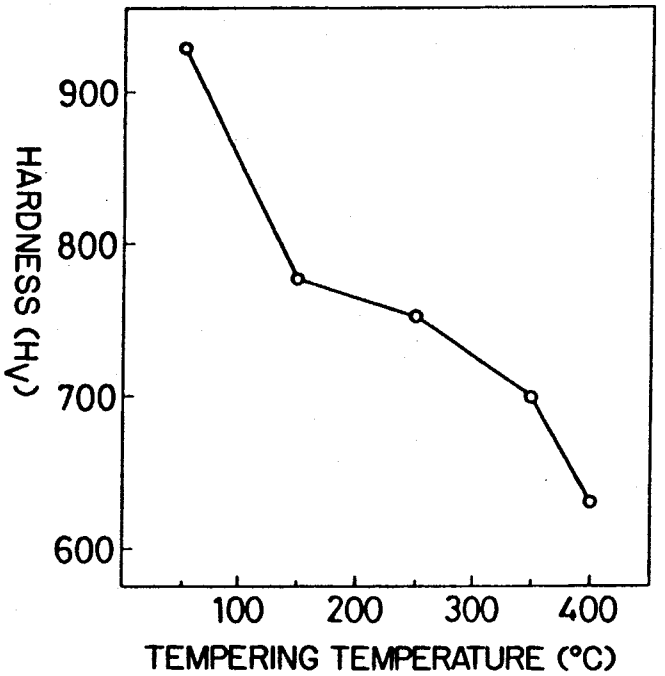

It is natural that if the tempering temperature is lowered, as shown in FIG. 1(A), the hardness is increased.

The tensile strength and the fatigue strength (by the rotating bending test) are correspondingly reduced, as shown by (b) in FIG. 1(B) and (D). However, in the case where the surface is subjected to these properties are electrolytic polishing, they are contrarily increased until a certain temperature (250° C. as for the tensile strength and 350° C. as for the fatigue strength) with the reduction of the tempering temperature, as shown by (a) in FIG. 1(B) and (D). That is to say, it was found that according to the conventional method, the strength of the matrix itself is not sufficiently exhibited due to the surface defects.

It can be found from the above description that even though the tensile strength after the quenching and the tempering treatment is increased over conventional materials, superior performances can be obtained by reducing the surface defects.

Figure 1C:
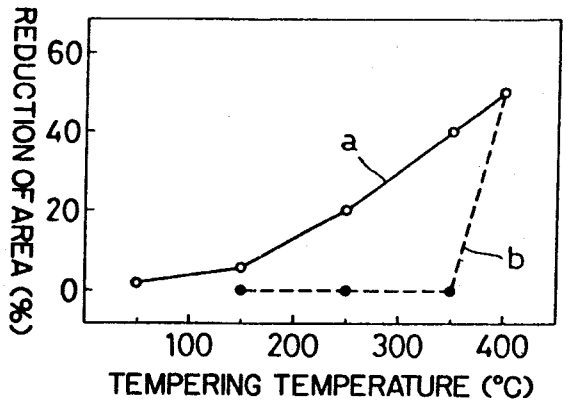
Figure 1D:
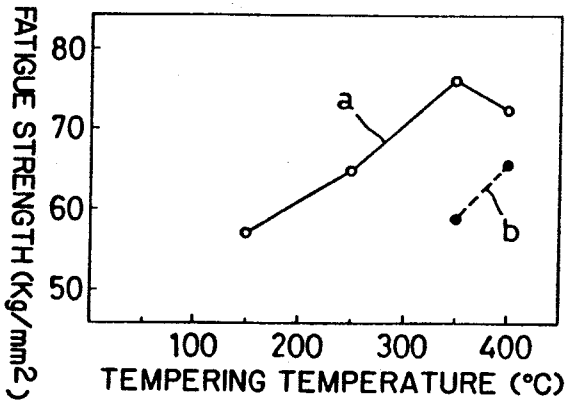
Figures 2, 3A:
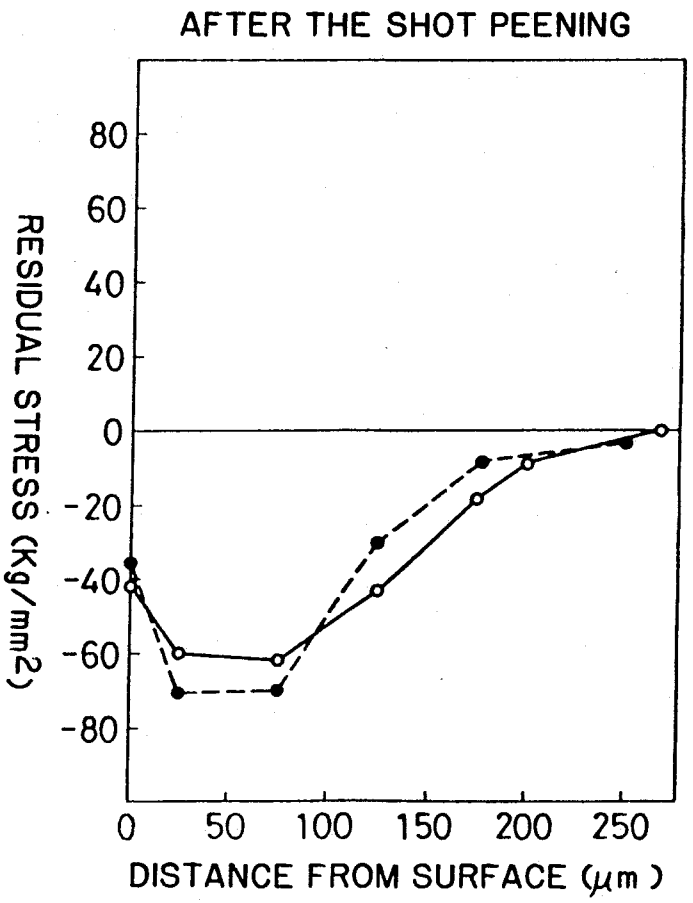
FIG. 3(A) and (B) is a graph showing the distribution of the residual stress on the inner side of a coil spring in a process (F-1) of the present invention and the conventional process (F-7).
Figures 1, 3A:
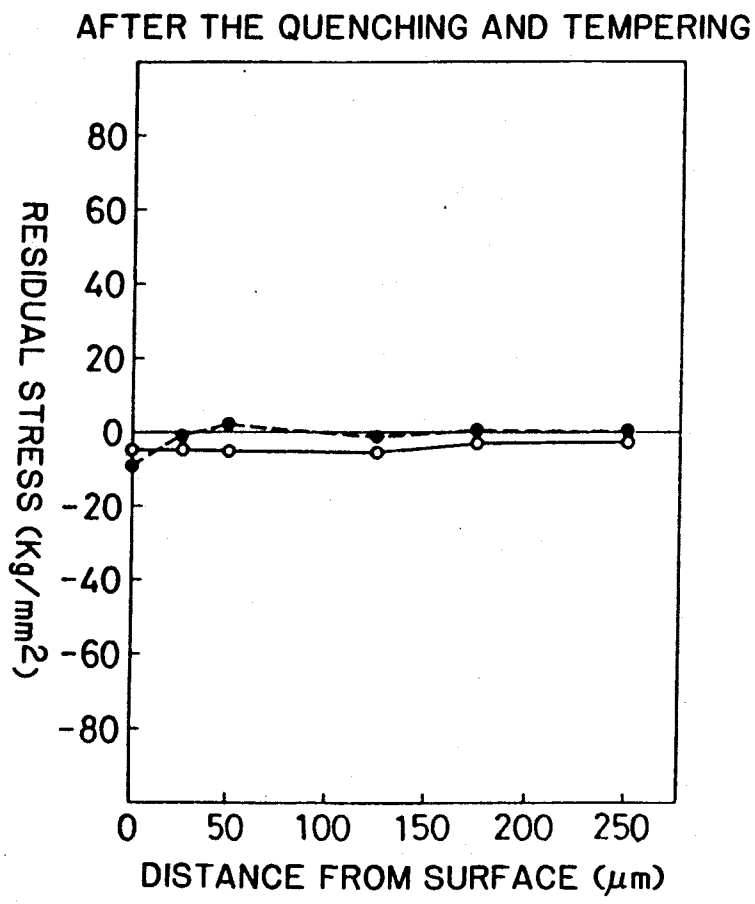
Figures 2, 3B:
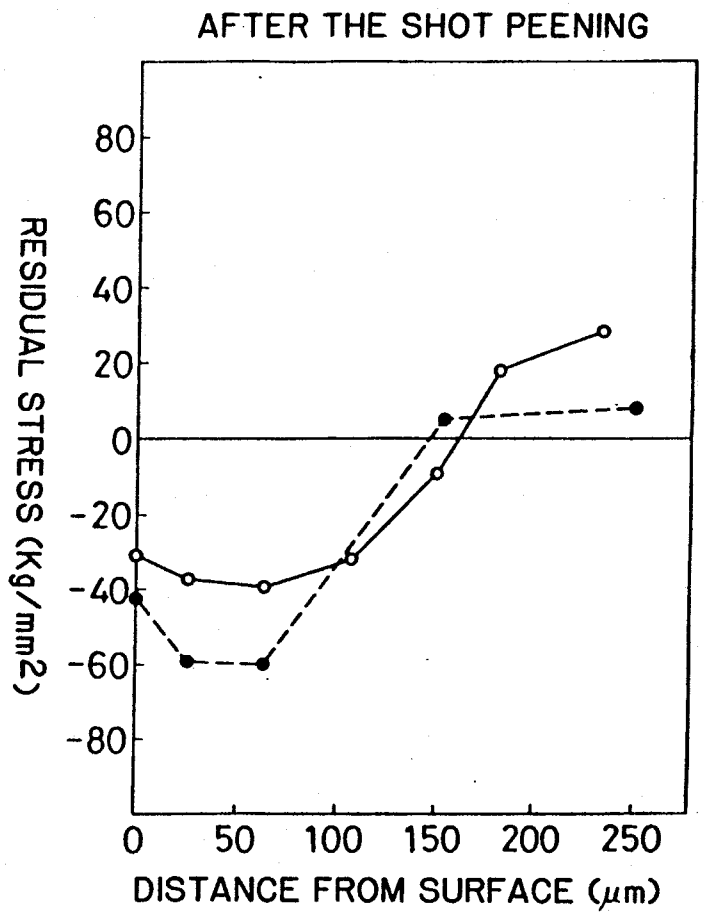
Figures 1, 3B:
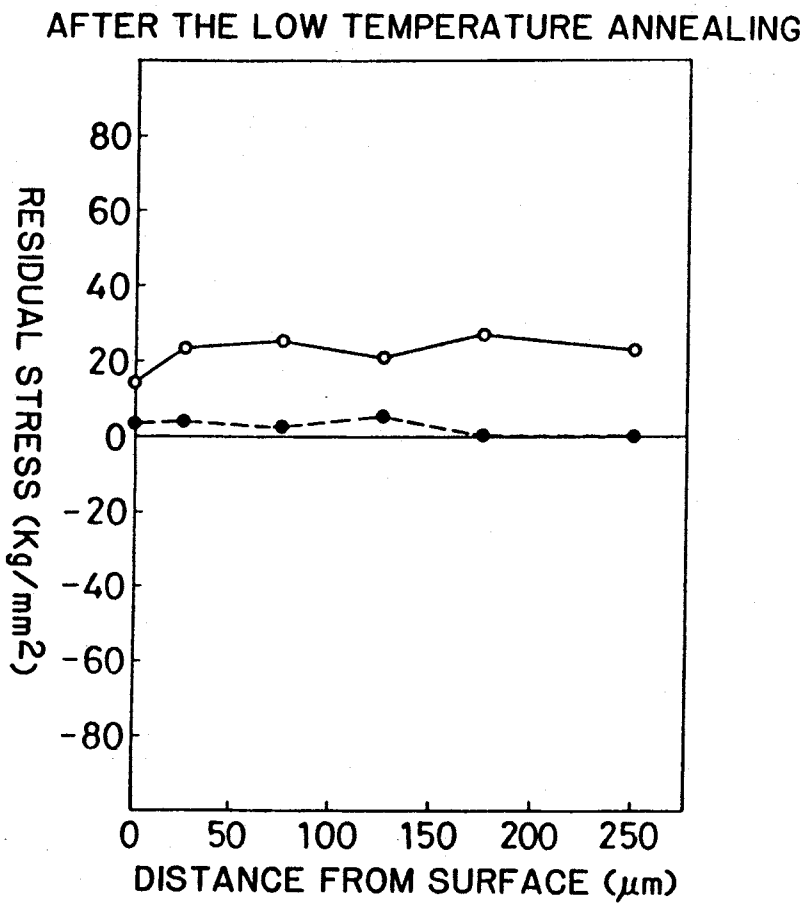

FIG. 1(C) is a graph showing the comparison of the steel wire (b) as heat treated with the steel wire (a) electrolytic polished after heat treatment as to the reduction of area.

Figure 2:
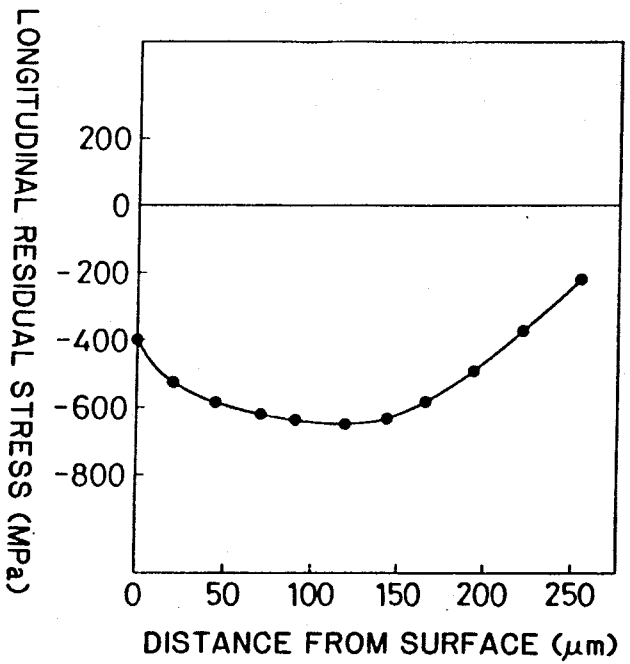
FIG. 2 is a graph which shows the distribution of the residual stress in the direction of the depth of the steel wire after the quenching treatment and the tempering treatment by the relationship between the distance from the surface and the longitudinal residual stress.

(iv) The reason why the polishing treatment is carried out after the shot peening treatment is that a zone having the largest compressive residual stress exists at a depth of 100 to 150 μm from the surface, as shown by FIG. 2 which is a graph showing the distribution of the residual stress in the direction of depth of a steel elementary wire after the quenching treatment and the tempering treatment. Accordingly, it is thought that if a thickness of a portion to be removed by the polishing treatment after the shot peening treatment is 100 μm or less, the compressive residual stress of the uppermost surface is rather increased, so that no bad influence is exerted on the fatigue characteristics.

The steel wire used in the present invention comprises C, Si, Mn, Cr, V, Fe and inevitable impurities but the content of C is limited within a range of 0.4 to 1.0% by weight, Si 0.1 to 2.0% by weight, Mn 0.4 to 1.2% by weight, Cr 0.3 to 1.5% by weight and V 0.001 to 0.3% by weight for the following reasons.

That is to say, if the content of C is less than 0.4% by weight, sufficient strength is not obtained and if content of C exceeds 1.0% by weight, shrink crackings are apt to be brought about during the quenching treatment.

If the content of Si is less than 0.1% by weight, the heat resistance is deteriorated and if the content of Si exceeds 2.0% by weight, cracks are apt to be brought about on the surface during the hot rolling.

If the content of Mn is less than 0.4% by weight, the quenchability is deteriorated to lead to an insufficient strength and if the content of Mn exceeds 1.2% by weight, the workability is deteriorated.

The content of Cr within the range of 0.3 to 1.5% by weight is effective for the obtainment of the superior hardenability and heat resistance.

The content of V within the range of 0.001 to 0.3% by weight is preferable in view of the preservation of the superior micronization of crystalline particles and hardenability.

PREFERRED EMBODIMENTS

The present invention will be below described in detail with reference to the preferred embodiments.

EXAMPLE 1

A steel wire with a diameter of 4.0 mm and chemical compositions and a cleanness characteristics shown in Table 1 was produced and springs of which dimensions is shown in Table 3, was produced by the manufacturing processes shown in Table 2 from this steel wire. And, the mechanical properties after the quenching treatment and the tempering treatment and the a number of cycles to fracture when the fatigue test was carried out at a mean clamping stress $\tau m$ of 60 kg/mm$^2$ and an amplitude stress $\tau a$ of 45 kg/mm$^2$ are shown in Table 4.

In addition, the mechanical properties of a sample obtained by coiling followed by being subjected to a quenching treatment and a tempering treatment in the manufacturing process shown in Table 2 are difficult to measure, so that the mechanical properties of this sample were substituted by the characteristic values of a sample obtained by subjecting an elementary wire, which had not been subjected to the coiling, to the same subsequent treatments. In addition, the results of the fatigue tests are the average values for n=4 to 11.

TABLE 1

Chemical Composition and Cleanness of Steel Wires to be Tested

| | C (wt %) | Si (wt %) | Mn (wt %) | P (wt %) | S (wt %) | Cr (wt %) | V (wt %) | Fe (wt %) | Cleanness (%) |
|---|---|---|---|---|---|---|---|---|---|
| A | 0.51 | 0.25 | 0.78 | 0.009 | 0.008 | 1.02 | 0.22 | Rest | 0.003 |
| B | 0.46 | 0.34 | 0.50 | 0.008 | 0.010 | 1.2 | 0.25 | Rest | 0.005 |
| C | 0.64 | 0.13 | 0.94 | 0.010 | 0.005 | 0.81 | 0.16 | Rest | 0.003 |
| D | 0.59 | 0.20 | 0.48 | 0.007 | 0.006 | 1.10 | 0.20 | Rest | 0.042 |
| E | 0.58 | 0.22 | 0.70 | 0.006 | 0.007 | 0.96 | 0.23 | Rest | 0.078 |

TABLE 2

Manufacturing Processes of Spring

| | Manufacturing Process |
|---|---|
| A-1 | Coiling → Quenching, Low-temperature tempering → Shot peening → Electrolytic polishing (Rmax = 4μ) |
| A-2 | Coiling → Quenching. Low-temperature tempering → Shot peening → Electrolytic polishing (Rmax = 3μ) |
| A-3 | Coiling → Quenching, Low-temperature tempering → Shot peening → Electrolytic polishing (Rmax = 7μ) |
| A-4 | Coiling → Quenching, Tempering → Shot peening → Electrolytic polishing (Rmax = 3μ) |
| A-5 | Coiling → Quenching, Cryogenic tempering → Shot peening → Electrolytic polishing (Rmax = 4μ) |
| A-6 | Coiling → Quenching, Cryogenic tempering → Shot peening → Electrolytic polishing (Rmax = 2μ) |
| A-7 | Quenching, Tempering → Coiling → Low-temperature annealing (400° C. × 15 min) → Shot peening |
| A-8 | Quenching, Tempering → Coiling → Low-temperature annealing (400° C. × 15 min) → Shot peening → Electrolytic polishing (Rmax = 2μ) |
| A-9 | Quenching, Low-temperature tempering → Coiling → Low-temperature annealing → Shot peening → Electrolytic polishing (Rmax = 4μ) |
| B-1 | Coiling → Quenching, Low-temperature tempering → Shot peening → Electrolytic polishing (Rmax = 3μ) |
| B-2 | Hot coiling followed by cooling → Quenching, Low-temperature tempering → Shot peening → Electrolytic polishing (Rmax = 4μ) |
| B-3 | Hot coiling at 870° C. followed by quenching as it is → Low-temperature tempering → Shot peening → Electrolytic polishing (Rmax = 3μ) |
| C-1 | Hot coiling at 870° C. followed by quenching as it is → Low-temperature tempering → Shot peening → Electrolytic polishing (Rmax = 4μ) |
| C-2 | Coiling at 870° C. followed by quenching as it is → Low-temperature tempering → Shot peening → Mechanical polishing (Rmax = 3μ) |
| D-1 | Coiling at 870° C. followed by quenching as it is → Low-temperature tempering → Shot peening → Mechanical polishing (Rmax = 3μ) |
| D-2 | Coiling → Quenching, Tempering → Shot peening |
| D-3 | Quenching, Tempering → Coiling → Low-temperature annealing → Shot peening |
| D-4 | Quenching, Tempering → Electrolytic polishing (Rmax = 4μ) |
| D-5 | Quenching, Low-temperature tempering → Low-temperature annealing → Shot peening → Electrolytic polishing (Rmax = 3μ) |
| E-1 | Coiling → Quenching, Low-temperature tempering → Shot peening → Electrolytic polishing (Rmax = 2μ) |

TABLE 3

Dimensions of Coil Spring

| | |
|---|---|
| Diameter of elementary wire | 4 mm |
| Average coil diameter | 24 mm |
| Free height | 55 mm |
| Total number of turns | 6.5 |
| Effective number of turns | 4.5 |

TABLE 4

Mechanical Properties and Fatigue Properties of Spring

| Type | Tensile strength (kg/mm$^2$) | Reduction of area (%) | Number of cycles at $\tau = 60 \pm 45$ kg/mm$^2$ |
|---|---|---|---|
| A-1 (**1) | 197 | 44 | $10^8$ or more |
| A-2 (**1) | 196 | 46 | $10^8$ or more |
| A-3 (**2) | 198 | 32 | $9.5 \times 10^6$ |
| A-4 (**2) | 165 | 50 | $4.6 \times 10^6$ |
| A-5 (**2) | 219 | 0 | $8.2 \times 10^5$ |
| A-6 (**2) | 219 | 0 | $9.6 \times 10^5$ |
| A-7 (**3) | 165 | 50 | $8.2 \times 10^6$ |
| A-8 (**2) | 165 | 50 | $5.5 \times 10^6$ |
| A-9 (**2) | 210 | 35 | $1.2 \times 10^7$ |
| B-1 (**1) | 191 | 46 | $7.6 \times 10^7$ (2/5 not broken)* |
| B-2 (**1) | 189 | 50 | $6.2 \times 10^7$ |
| B-3 (**1) | 187 | 49 | $5.8 \times 10^7$ |
| C-1 (**1) | 184 | 46 | $8.2 \times 10^7$ (3/5 not broken)* |
| C-2 (**1) | 185 | 43 | $6.9 \times 10^7$ (1/5 not broken)* |
| D-1 (**2) | 194 | 35 | $8.9 \times 10^6$ |
| D-2 (**2) | 168 | 44 | $1.2 \times 10^6$ |
| D-3 (**3) | 168 | 44 | $1.9 \times 10^6$ |
| D-4 (**2) | 166 | 46 | $7.2 \times 10^5$ |
| D-5 (**2) | 192 | 0 | $9.5 \times 10^5$ |
| E-1 (**2) | 194 | 0 | $2.2 \times 10^5$ |

Note:
**1 indicates a preferred embodiment of the present invention,
**2 indicating a comparative example. and
**3 indicating the conventional example.
*In the case where the breakage does not occur at the number of repeated times of $10^8$, an average value was calculated on the basis of $10^8$.

EXAMPLE 2

A steel wire with a diameter of 4.0 mm and a chemical composition and a cleanness shown in Table 5 was produced and springs having the same dimensions as those shown in Table 3 of EXAMPLE 1 were produced by the manufacturing processes shown in Table 6 from this steel wire. And, the mechanical properties after the quenching treatment and the tempering treatment and a number of cycles to fracture when the fatigue test was carried out at a mean clamping stress $\tau m$ of 60 kg/mm$^2$ and an amplitude stress $\tau a$ of 50 kg/mm$^2$ were shown in Table 7.

In addition, the mechanical properties of a sample obtained by coiling followed by being subjected to a quenching treatment and a tempering treatment in the manufacturing process shown in Table 6 are difficult to measure, so that the mechanical properties of this sample were substituted by characteristic values as to a sample obtained by subjecting an elementary wire, which had not been subjected to the coiling, to the same subsequent treatments. In addition, the results of the fatigue tests are such that the average values for n=4 to 11.

TABLE 5

Chemical Compositions and Cleanness of Steel Wires to be Tested

| | C (wt %) | Si (wt %) | Mn (wt %) | P (wt %) | S (wt %) | Cr (wt %) | V (wt %) | Fe (wt %) | Cleanness (%) |
|---|---|---|---|---|---|---|---|---|---|
| F | 0.64 | 1.43 | 0.68 | 0.007 | 0.013 | 0.70 | 0.002 | Rest | 0.004 |
| G | 0.50 | 1.21 | 0.52 | 0.006 | 0.009 | 0.54 | 0.002 | Rest | 0.003 |
| H | 0.77 | 1.64 | 0.80 | 0.010 | 0.010 | 1.02 | 0.003 | Rest | 0.008 |
| I | 0.62 | 1.47 | 0.65 | 0.009 | 0.015 | 0.69 | 0.002 | Rest | 0.026 |
| J | 0.62 | 1.44 | 0.68 | 0.007 | 0.012 | 0.68 | 0.004 | Rest | 0.089 |

TABLE 6

Manufacturing Processes of Spring

| | Manufacturing Process |
|---|---|
| F-1 | Coiling → Quenching. Low-temperature tempering → Shot peening → Electrolytic polishing (Rmax = 3μ) |
| F-2 | Coiling → Quenching, Low-temperature tempering → Shot peening → Electrolytic polishing (Rmax = 2μ) |
| F-3 | Coiling → Quenching. Low-temperature tempering → Shot peening → Electrolytic polishing (Rmax = 8μ) |
| F-4 | Coiling → Quenching. Tempering → Shot peening → Electrolytic polishing (Rmax = 3μ) |
| F-5 | Coiling → Quenching, Cryogenic tempering → Shot peening → Electrolytic polishing (Rmax = 3μ) |
| F-6 | Coiling → Quenching, Cryogenic tempering → Shot peening → Electrolytic polishing (Rmax = 2μ) |
| F-7 | Quenching. Tempering → Coiling → Low-temperature annealing (400° C. × 15 min) → Shot peening |
| F-8 | Quenching. Tempering → Coiling → Low-temperature annealing (400° C. × 15 min) → Shot peening → Electrolytic polishing (Rmax = 3μ) |
| F-9 | Quenching, Low-temperature tempering → Coiling → Low-temperature annealing → Shot peening → Electrolytic polishing (Rmax = 3μ) |
| G-1 | Coiling → Quenching, Low-temperature tempering → Shot peening → Electrolytic polishing (Rmax = 3μ) |
| G-2 | Hot coiling followed by cooling → Quenching, Low-temperature tempering → Shot peening → Electrolytic polishing (Rmax = 3μ) |
| G-3 | Hot coiling at 870° C. followed by quenching as it is → Low-temperature tempering → Shot peening → Electrolytic polishing (Rmax = 3μ) |
| H-1 | Hot coiling at 870° C. followed by quenching as it is → Low-temperature tempering → Shot peening → Electrolytic polishing (Rmax = 4μ) |
| H-2 | Hot coiling at 870° C. followed by quenching as it is → Low-temperature tempering → Shot peening → Mechanical polishing (Rmax = 4μ) |
| H-3 | Heating to 870° C. → Chilling to 500° C., Coiling at 500° C. → Quenching, Low-temperature tempering → Shot peening → Electrolytic polishing |
| I-1 | Hot coiling at 870° C. followed by quenching as it is → Low-temperature tempering → Shot peening → Mechanical polishing (Rmax = 4μ) |
| I-2 | Coiling → Quenching, Tempering → Shot peening |
| I-3 | Quenching. Tempering → Coiling → Low-temperature annealing → Shot peening |
| I-4 | Quenching, → Electrolytic polishing (Rmax = 3μ) |
| I-5 | Quenching, Low-temperature tempering → Coiling → Low-temperature annealing → Shot peening → Electrolytic polishing (Rmax = 3μ) |
| J-1 | Coiling → Quenching. Low temperature tempering → Shot peening → Electrolytic polishing (Rmax = 3μ) |

TABLE 7

Mechanical Properties and Fatigue Properties of Spring

| Type | Tensile strength (kg/mm$^2$) | Reduction of area (%) | Number of cycles at $\tau$ = 60 ± 50 kg/mm$^2$ |
|---|---|---|---|
| F-1 (**1) | 229 | 41 | $10^8$ or more |
| F-2 (**1) | 228 | 42 | $10^8$ or more |
| F-3 (**2) | 226 | 29 | $2.3 \times 10^7$ |
| F-4 (**2) | 198 | 47 | $4.8 \times 10^6$ |
| F-5 (**2) | 248 | 19 | $1.2 \times 10^6$ #1 |
| F-6 (**2) | 248 | 20 | $1.7 \times 10^6$ #1 |
| F-7 (**3) | 198 | 45 | $4.2 \times 10^6$ |
| F-8 (**2) | 198 | 47 | $7.5 \times 10^6$ |
| F-9 (**2) | 228 | 41 | $3.9 \times 10^7$ #2 |
| G-1 (**1) | 219 | 46 | $10^8$ or more |
| G-2 (**1) | 221 | 44 | $10^8$ or more |
| G-3 (**1) | 215 | 41 | $8.5 \times 10^7$ #3 |
| H-1 (**1) | 235 | 39 | $8.9 \times 10^7$ #3 |
| H-2 (**1) | 235 | 39 | $10^8$ or more |
| H-3 (**1) | 215 | 48 | $10^8$ or more |
| I-1 (**2) | 227 | 32 | $1.2 \times 10^7$ |
| I-2 (**2) | 199 | 39 | $2.1 \times 10^6$ |
| I-3 (**3) | 199 | 39 | $1.5 \times 10^6$ |
| I-4 (**2) | 199 | 41 | $2.0 \times 10^6$ |
| I-5 (**2) | 227 | 22 | $1.5 \times 10^6$ |
| J-1 (**2) | 227 | 0 | $5.1 \times 10^5$ |

Note:
**1 indicates a preferred embodiment of the present invention,
**2 indicating a comparative example, and
**3 indicating the conventional example.
#1 indicates that the fluctuation is large.
#2 indicates that some pieces are broken during the coil forming thereof and the fluctuation in shape is large.
#3 indicates that 2 pieces of 5 pieces are not broken and $10^8$ was adopted for the calculation of an average value of the pieces which were not broken.

It is found from the above described Table 4 of EXAMPLE 1 and Table 7 of EXAMPLE 2 that springs obtained by A-1, A-2, B-1, B-2, B-3, C-1, C-2, F-1, F-2, G-1, G-2, G-3, H-1, H-2 and H-3, which are the preferred embodiments of the present invention, are remarkably superior in fatigue useful life time.

Springs of D, E, I and J types inferior in cleanness, that is D-1, D-2, D-3, D-4, D-5, E-1, I-1, I-2, I-3, I-4, I-5 and J-1 are inferior in fatigue resistance. In addition, even in the case where steel wires containing the chemical compositions of A and F types are used, springs obtained by the manufacturing processes, in which the electrolytic polishing is not or insufficiently carried out, that is springs obtained by the processes of A-3, A-7, F-3 and F-7, are inferior in fatigue resistance.

Besides, also springs obtained by A-8 and F-8, which are the conventional manufacturing processes of A-7 and F-7 plus the electrolytic polishing process, are inferior to those obtained according to the preferred embodiments of the present invention in fatigue resistance.

Furthermore, springs obtained by A-4, A-5, A-6, F-4, F-5 and F-6, of which conditions are similar to those in the preferred embodiments of the present invention but the tempering conditions are not suitable, do not exhibit the sufficient fatigue resistance when they are too hard or soft.

Springs obtained by A-9 and F-9, of which treatment conditions in each process are same as those in the preferred embodiments of the present invention but the sequence of the processes are different, show problems in that they are inferior in fatigue resistance and difficult to be formed into springs.

Springs obtained by B-2 and G-2, in which the hot coiling is carried out, and springs obtained by B-3 and G-3, in which the hot coiling is carried out and then the quenching is carried out at that temperature, all exhibit superior fatigue resistance if the same low-temperature tempering process and subsequent processes as those in the preferred embodiments of the present invention are adopted.

It has been found from the above described EXAMPLE 1 and EXAMPLE 2 that a long useful life time of almost $10^8$ as tested by the fatigue test at $\tau=60\pm45$ kg/mm$^2$ (the fatigue test at $\tau=60\pm50$ kg/mm$^2$ for chromium-silicon steel wire) if a chromium-vanadium steel wire or a chromium-silicon steel wire is subjected to the cold or hot coiling and then the quenching and tempering treatment to adjust its tensile strength larger than that of a chromium-vanadium steel oil-tempered wire for use in a valve spring according to JIS G-3565 by about 10% or the value larger than the tensile strength of a chromium-silicon steel oil-tempered wire for use in a valve spring according to JIS G-3566 by about 10% and the subsequent shot peening followed by the polishing treatment to give the surface roughness Rmax of 5 μm or less.

In addition, graphs showing the distribution of residual stress inside the coil after each process of F-1, which is the preferred embodiment of the present invention, and F-7, which is the conventional example, are shown in FIG. 3. In FIG. 3, a full line shows a longitudinal direction and a dotted line shows a tangential direction.

It is found from FIG. 3 that in F-1 the residual stress before the shot peening is about ±0 but in F-7 a residual tensile stress is remained in the longitudinal direction.

Accordingly, it seems that a compressive residual stress in the longitudinal direction after the shot peening in F-7 is reduced as much as that and the fatigue resistance is deteriorated.

On the other hand, it is found that in both F-1 and F-7 the compressive residual stress in a zone until a depth of 20 μm from the surface after the shot peening is smaller than that in a zone deeper than 20 μm.

Accordingly, it is found that the removal of the surfaces having the surface roughness of 20 μm or less by the polishing treatment has no bad influence upon the fatigue resistances on the whole.

In F-1 and H-1 in EXAMPLE 2 the thickness of the surface layer removed by the polishing treatment was 15 μm and that in H-2 was 12 μm.

EFFECTS OF THE INVENTION

As above described, the spring obtained by the present invention exhibits remarkably superior fatigue resistance, so that it is very useful for purposes, such as valve spring for use in car engine, requiring the reliability.

What is claimed is:

1. A high-strength coil spring produced by coiling a steel wire having a tensile strength by about 10% higher than that of the values shown in Table 3-2 as described in JIS G 3565, based upon the diameter of the steel wire used to produce the coil spring, said coil spring consisting essentially of C of 0.4 to 0.7% by weight, Si of 0.1 to 0.4% by weight, Mn of 0.4 to 1.2% by weight, Cr of 0.6 to 1.5% by weight, V of 0.1 to 0.3% by weight, and Fe and residual impurities, and having an index of cleanliness adjusted to 0.01% or less as measured according to JIS G 0555 to form it into a desired spring shape, then subjecting the thus-produced coil spring to a quenching and tempering treatment at temperatures lower than that employed in the conventional tempering treatment as described in FIGS. 1(A) to 1(D) of the specification, and finally to a shot peening treatment, further followed by a polishing treatment to remove injured portions from the surface defects produced by the shot peening so as to impart a surface roughness Rmax of 5 μm or less to the coil spring by removing a suface layer 6–20 μm therefrom.

2. A method of producing a high-strength coil spring from a steel wire having a tensile strength of about 10% higher than that of the values shown in Table 3-2 as described in JIS G 3565, based upon the diameter of the wire used to produce the coil spring characterized in that a steel wire consisting essentially of C of 0.4 to 0.7% by weight, Si of 0.1 to 0.4% by weight, Mn of 0.4 to 1.2% by weight, Cr of 0.6 to 1.5% by weight, V of 0.1 to 0.3% by weight, and Fe and residual impurities, and having an index of cleanliness adjusted to 0.01% or less as measured according to JIS G 0555, is subjected to a coiling to form it into a desired spring shape, then to a quenching and tempering treatment at temperatures lower than that employed in the conventional tempering treatment as described in FIGS. 1(A)–1(D) of the specification and finally to a shot peening treatment, further followed by a polishing treatment, so as to impart a surface roughness Rmax of 5 μm or less by removing a surface layer 6–20μm thick therefrom.

3. A high-strength coil spring produced from a steel wire having a tensile strength of about 10% higher than that of the values shown in Table 3-2 of JIS G 3566, based upon the diameter of the wire used to produce the coil spring, said coil spring consisting essentially of C of 0.4 to 1.0% by weight, Si of 1.0 to 2.0% by weight, Mn of 0.4 to 1.0% by weight, Cr of 0.3 to 1.5% by weight, and Fe and residual impurities, and having an index of cleanliness adjusted to 0.01% or less as measured by JIS G 0555, to a coiling step to form it into a desired spring shape, then subjecting the thus-produced coil spring to a quenching and tempering treatment at temperatures lower than that employed in the conventional tempering treatment as described in FIG. 1(A)–1(D) of the specification, and finally to a shot peening treatment, further followed by a polishing treatment to remove injured portions from the surface defects as a result of the shot peening to impart a surface roughness Rmax of 5μm or less to the coil spring by removing a surface layer 6–20μm thick therefrom.

4. A method of producing a high-strength coil spring from a steel wire having a tensile strength of about 10% higher than that of the values shown in Table 3-2 as described in JIS G 3566, based upon the diameter of the steel wire, characterized in that a steel wire comprising C of 0.4 to 1.0% by weight, Si of 1.0 to 2.0% by weight, Mn of 0.4 to 1.0% by weight, Cr of 0.3 to 1.5% by weight, and Fe and residual impurities, and having an index of cleanliness adjusted to 0.01% or less, is subjected to a oiling step to form it into a desired spring shape, then to a quenching and tempering treatment at temperatures lower than that employed in the conventional tempering treatment as described in FIGS. 1(A-)-1(D) of the specification to adjust the tensile strength, and finally to a shot peening treatment further followed by a polishing treatment so as to impart a surface roughness Rmax of 5μm or less by removing a surface layer 100 μm thick or less therefrom.

5. A method of producing a high-strength coil spring as set forth in claims 1 or 2, characterized in that the coiling of the steel wire is carried out by cold forming.

6. A method of producing a high-strength coil spring as set forth in claims 1 or 2, characterized in that the coiling of the steel wire is carried out by hot forming.

7. A method of producing a high-strength coil spring as set forth in claim 1 or 2, characterized in that the coiling of the steel wire is carried out at high temperatures of 850° C. or more and then subjected to a quenching treatment.

8. A method of producing a high-strength coil spring as set forth in claims 1 ro 2, characterized in that the steel wire is heated to 850° C. or more and then subjected to a coil forming at temperatures of 400° to 600° C., followed by subjecting it to quenching treatment.

9. A high-strength coil spring according to claim 1 wherein the 0.01% or less index of cleanliness represents the amount of nonmetallic inclusions in the steel wire.

10. The method of producing a high-strength coil spring according to claim 2 wherein the index of cleanliness represents the amount of nonmetallic inclusions in the steel wire and is controlled by deoxidizing the steel wire so as to reduce the nonmetallic inclusions to 0.01% or less.

* * * * *